US011555279B2

(12) United States Patent
Cuellar

(10) Patent No.: US 11,555,279 B2
(45) Date of Patent: Jan. 17, 2023

(54) INTERLOCKING CONCRETE PAVEMENT DRAIN

(71) Applicant: Jose Luis Cuellar, Lakeside, CA (US)

(72) Inventor: Jose Luis Cuellar, Lakeside, CA (US)

( * ) Notice: Subject to any disclaimer, the term of this patent is extended or adjusted under 35 U.S.C. 154(b) by 0 days.

(21) Appl. No.: 15/962,985

(22) Filed: Apr. 25, 2018

(65) Prior Publication Data

US 2019/0330809 A1 Oct. 31, 2019

(51) Int. Cl.
*E01F 5/00* (2006.01)

(52) U.S. Cl.
CPC ..... *E01F 5/00* (2013.01)

(58) Field of Classification Search
CPC ..... E02B 11/00; E01F 5/00; E01C 11/224
USPC ..... 404/2, 4, 5; 210/163; 405/36, 52
See application file for complete search history.

(56) References Cited

U.S. PATENT DOCUMENTS 853,750 A * 5/1907 Whorrall ..... F16L 11/18 138/120
860,252 A * 7/1907 Schnaier ..... E03F 5/0404 137/247.25
2,550,402 A * 4/1951 Boosey ..... E03F 5/0407 210/165
2,605,492 A * 8/1952 Twerdahl ..... A47L 13/58 D32/54
2,672,205 A * 3/1954 McDonald ..... E03C 1/22 285/42
2,783,852 A * 3/1957 Sisk ..... E03F 5/0408 210/165
D280,126 S * 8/1985 Provan ..... D23/262
4,594,739 A * 6/1986 Watts ..... E03C 1/26 137/844
D337,154 S * 7/1993 Simpson ..... D23/270
5,360,284 A * 11/1994 Allard ..... E03F 5/0401 404/2
5,486,287 A * 1/1996 Murphy ..... B01D 29/01 210/164
5,722,791 A * 3/1998 Dallmer ..... E04D 13/0409 210/163
6,109,824 A * 8/2000 Annes ..... E03F 5/0401 404/25
D498,521 S * 11/2004 Bayer ..... D23/293.1
6,997,636 B2 * 2/2006 Tremouilhac ..... E03F 5/046 210/163
7,025,529 B2 * 4/2006 Boudreau ..... E02D 29/1409 404/25
7,040,938 B2 * 5/2006 Choi ..... B60F 3/0038 114/283
7,096,627 B2 * 8/2006 Wade ..... E04D 13/0645 137/357
D532,877 S * 11/2006 Hisey ..... D23/304
D552,719 S * 10/2007 Petner ..... D23/261
7,891,907 B2 * 2/2011 Smith ..... E04D 13/0409 405/36

(Continued)

FOREIGN PATENT DOCUMENTS

GB 2209782 A * 5/1989 ..... E01C 11/227

*Primary Examiner* — Thomas B Will
*Assistant Examiner* — Katherine J Chu

(57) ABSTRACT

A pavement drain has a perimeter formed by sidewalls, and a drain aperture at the center of the perimeter. A drain surface is provided between form a path from the sidewalls to the drain aperture. A circular protrusion is concentric with the drain aperture and extends downwards from drain surface to engage with a drain pipe.

7 Claims, 7 Drawing Sheets

(56) References Cited

U.S. PATENT DOCUMENTS

| | | | | |
|---|---|---|---|---|
| 8,256,505 | B1 * | 9/2012 | Rose | E21B 43/0122 166/167 |
| 9,139,989 | B2 * | 9/2015 | Meyers | E03C 1/264 |
| D796,648 | S * | 9/2017 | Francesconi | D23/284 |
| D813,361 | S * | 3/2018 | Krahn | D23/308 |
| D844,116 | S * | 3/2019 | Villarreal | D23/259 |
| D860,415 | S * | 9/2019 | Bucher | D23/304 |
| 2006/0026752 | A1 * | 2/2006 | Torres | A47K 3/40 4/613 |
| 2006/0048469 | A1 * | 3/2006 | MacLean | E03F 5/0402 52/220.3 |
| 2007/0034577 | A1 * | 2/2007 | Bayard | E03F 5/06 210/767 |
| 2008/0189926 | A1 * | 8/2008 | Luxton | E03F 5/0408 29/428 |
| 2008/0222793 | A1 * | 9/2008 | Cook | A47K 3/40 4/612 |
| 2010/0320130 | A1 * | 12/2010 | Meyers | E03F 5/04 210/164 |
| 2019/0055727 | A1 * | 2/2019 | Jones | E03F 5/0408 |
| 2019/0191932 | A1 * | 6/2019 | Costello | A47K 3/40 |

* cited by examiner

INTERLOCKING CONCRETE PAVEMENT DRAIN

BACKGROUND OF THE INVENTION

Segmental or interlocking pavement systems are a type of hardscape made up of multiple pavers, which are typically set in sand. Interlocking pavement systems built from concrete pavers have emerged as a popular alternative to full pour concrete. The interlocking pavement systems are ideal for areas prone to shifting because they will not crack like poured concrete.

The spaces between the pavers of an interlocking pavement system allow for multiple drainage or irrigation options. Most paver drains currently on the market provide for a linear drainage system. The linear drainage systems are prone to blockage and difficult to install. Installation of these linear systems requires multiple pavers to be cut, settings to be altered, and causes irregularities in paver patterns.

Based on the foregoing, there is a need in the art for an interlocking concrete pavement drain which is efficient and easy to install. What would be further desired is a drain which is dimensioned to be the same size as the individual pavers in an interlocking concrete pavement system.

SUMMARY OF THE INVENTION

In an embodiment a pavement drain comprises one or more sidewalls which form the perimeter of the drain. A drain aperture is provided at the center of the drain, and one or more drain surfaces extend from the sidewalls to the drain aperture to create a path for fluid. A circular protrusion is provided below the drain surface and extending downward. The circular protrusion is concentric to the drain aperture and has a larger diameter than a diameter than the drain aperture.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF EMBODIMENTS

Figure 1:
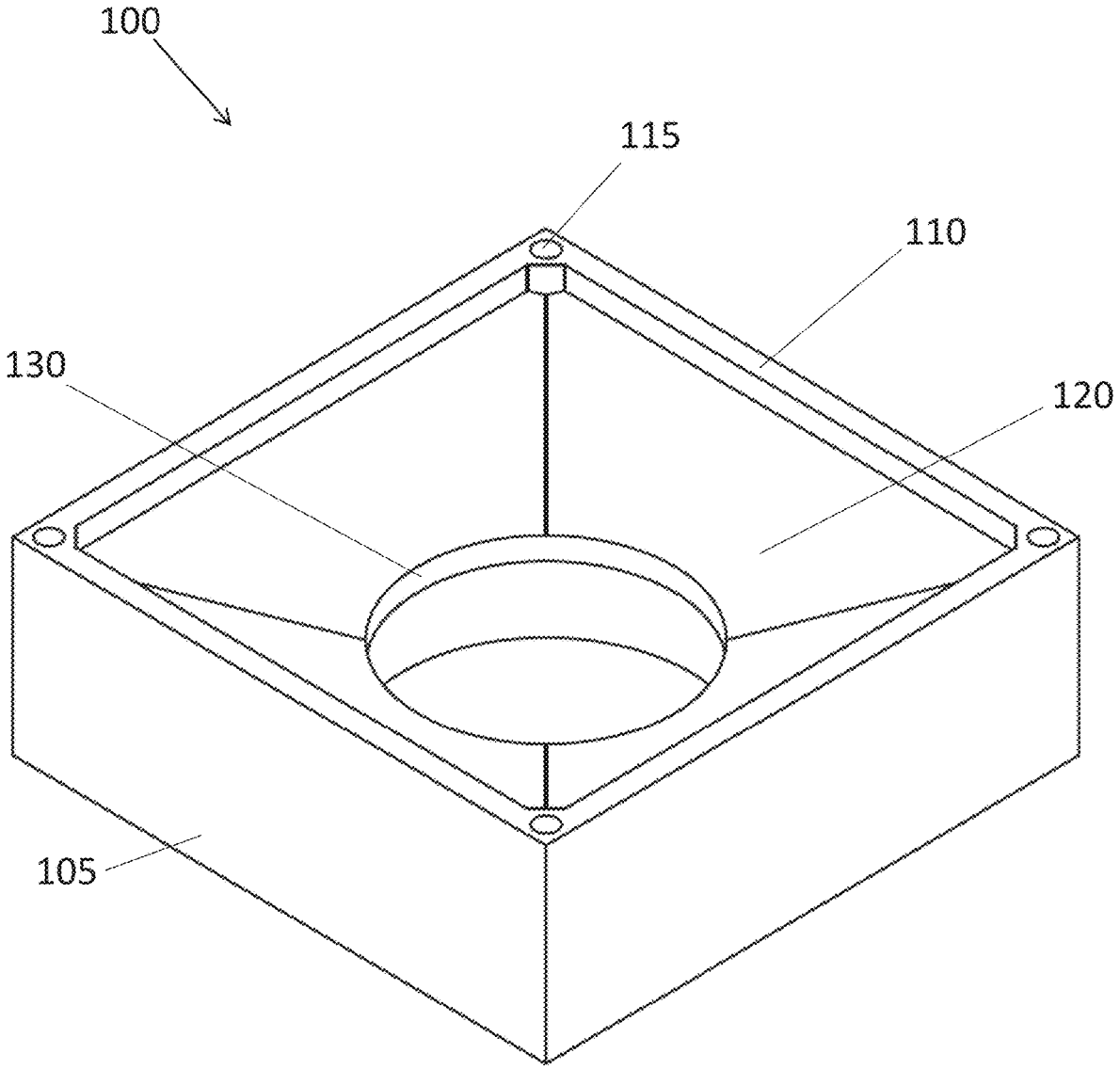
FIG. 1 is a top perspective view of the pavement drain, according to an embodiment of the present invention.
Figure 2:
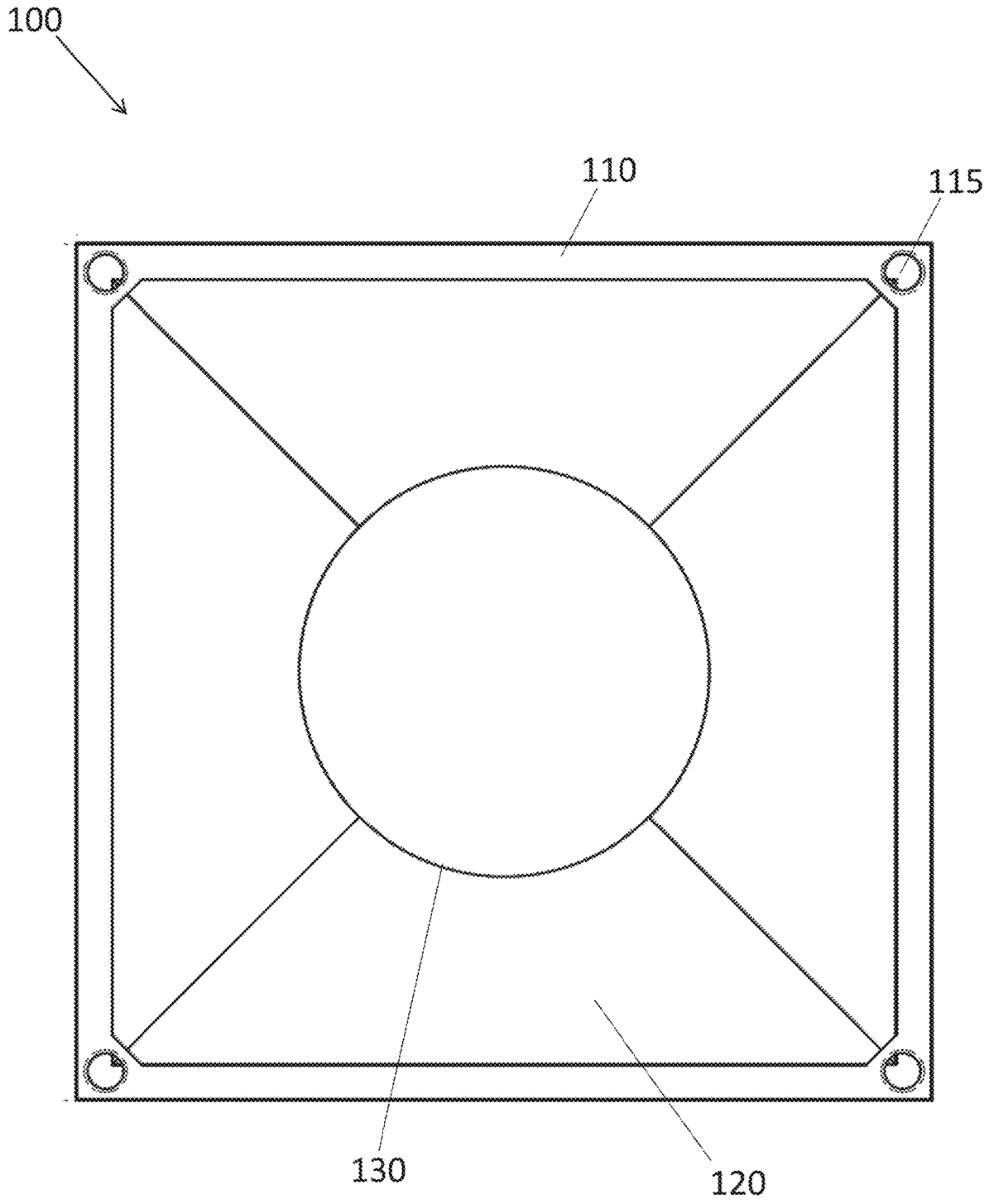
FIG. 2 is a top view of the pavement drain, according to an embodiment of the present invention.
Figure 3:
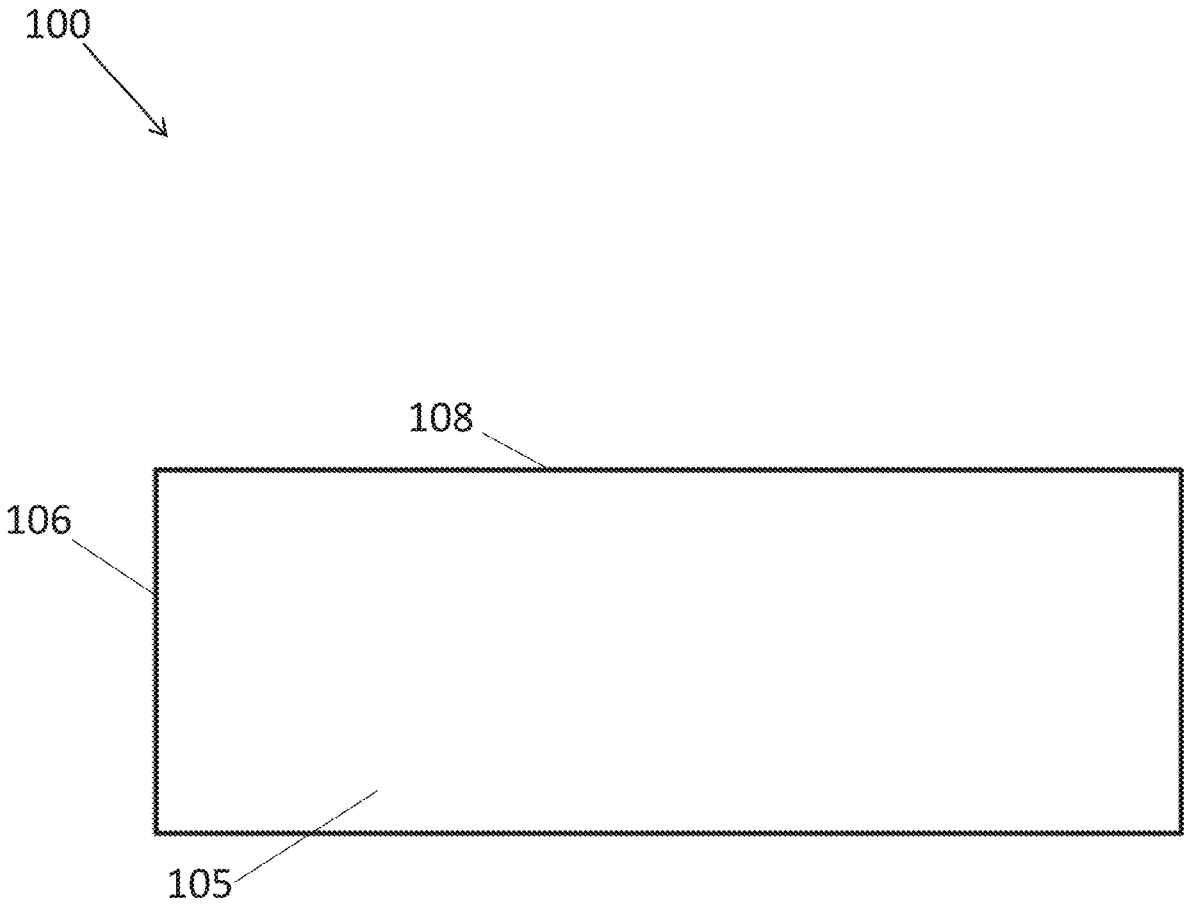
FIG. 3 is a side view of the pavement drain, according to an embodiment of the present invention.
Figure 4:
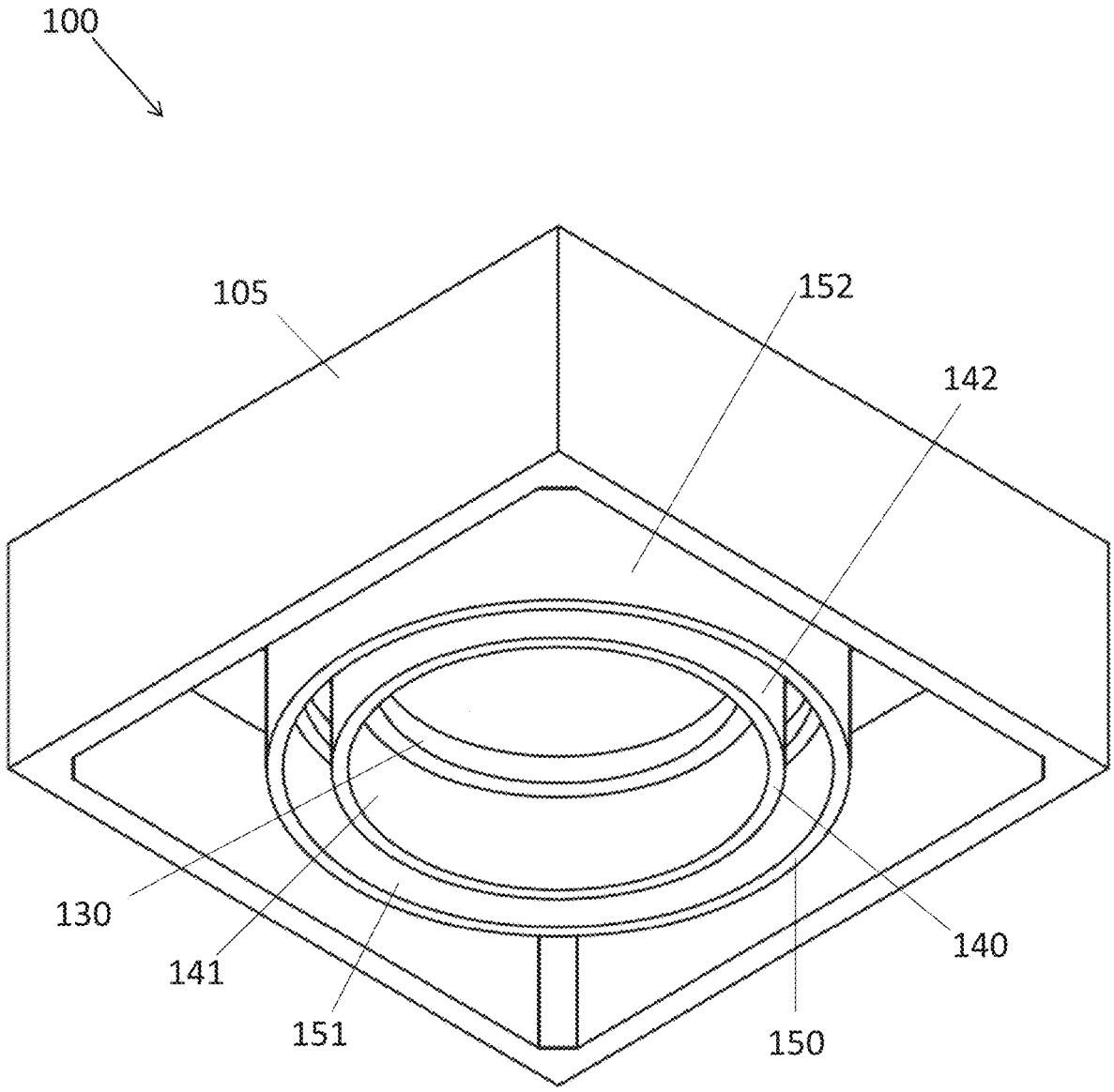
FIG. 4 is a bottom perspective view of the pavement drain, according to an embodiment of the present invention.
Figure 5:
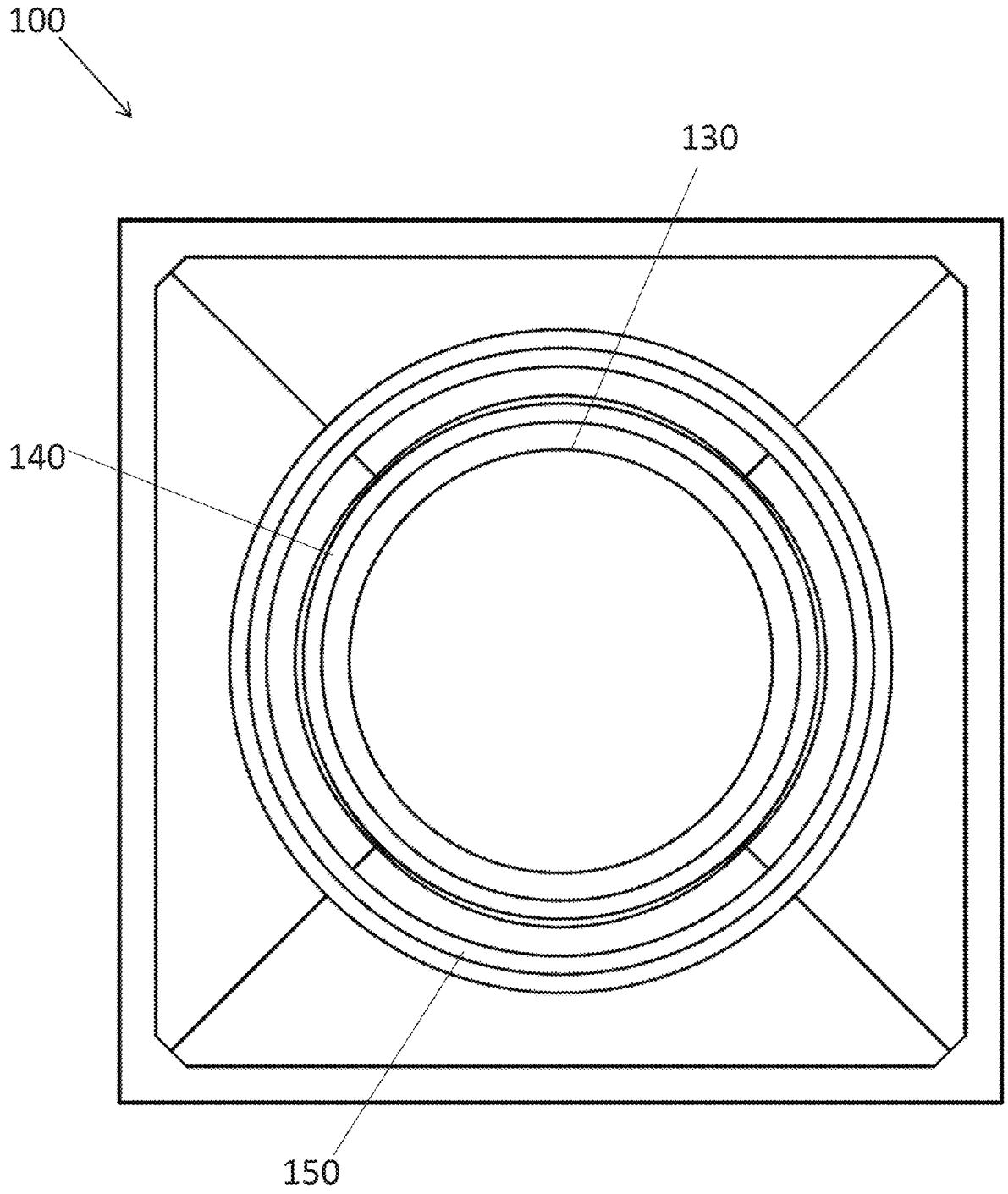
FIG. 5 is a bottom view of the pavement drain, according to an embodiment of the present invention.

Embodiments of the present invention and their advantages may be understood by referring to FIGS. 1-7, wherein like reference numerals refer to like elements.

Figure 6:
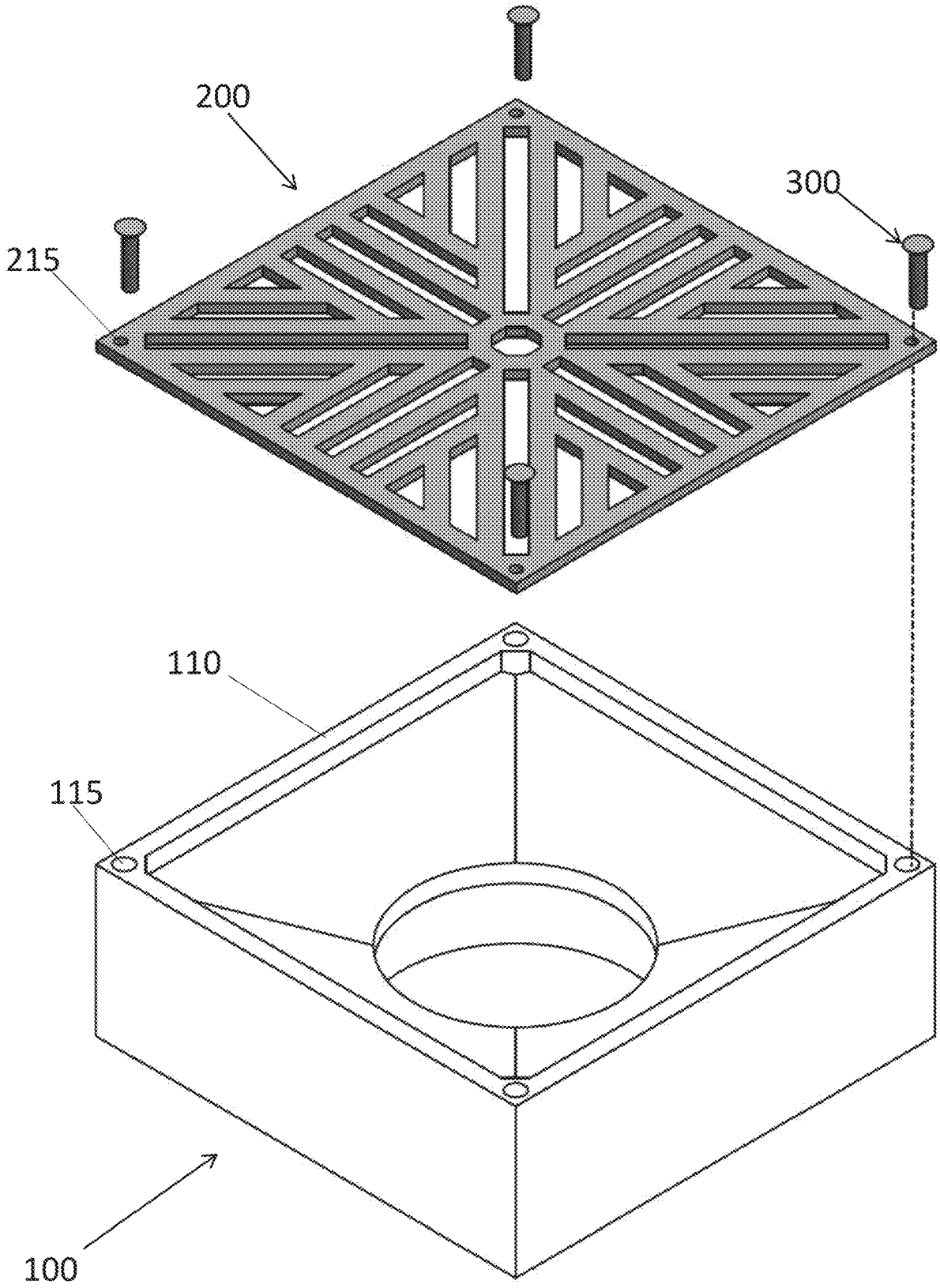
FIG. 6 is a perspective view of the pavement drain and drain plate, according to an embodiment of the present invention.

With reference to FIGS. 1-5, a pavement drain 100 is shown, according to an embodiment of the present invention. In the embodiment, the pavement drain 100 is comprises sidewalls 105, which form the exterior and box dimensions of the drain. The center of the drain is comprised of drain surfaces 120. The drain surfaces slope downward towards the drainage aperture 130. In an embodiment, the sidewalls 105 protrude above the drain surfaces 120 and create a lip 110 which provides a planar face for a drain plate (200 as shown in FIG. 6) to be attached to the drain via screws (300 as shown in FIG. 6) engaging into screw holes 115.

Figure 7:
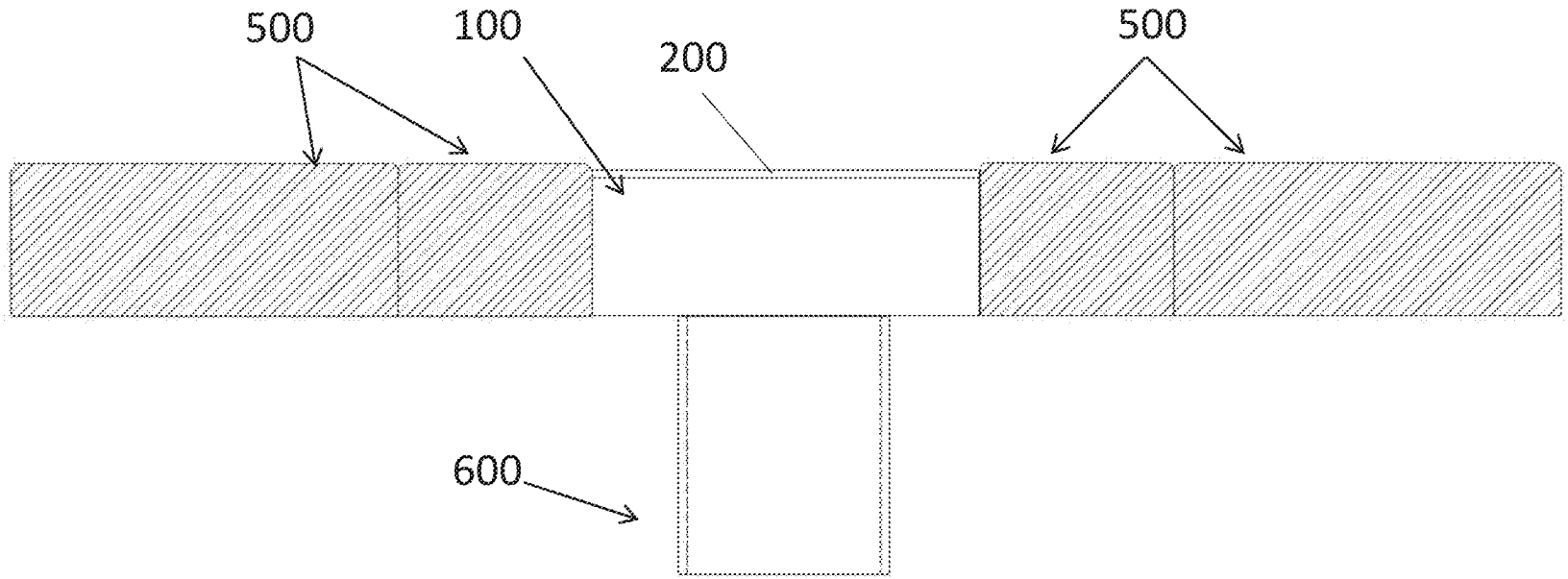
FIG. 7 is a cross-sectional view of the pavement drain positioned in a pavement system, according to an embodiment of the present invention.

In an embodiment, the bottom of the pavement drain 100 is provided with a first circular protrusion 140 adapted to retain a drain pipe (600 as shown in FIG. 7) and a second circular protrusion 150 adapted to retain a drain pipe of a larger diameter. In an embodiment, the inner walls 141, 151 of the first and second circular protrusions, respectively, are adapted to engage the outer circumference of a drain pipe with a press fit. In another embodiment, the outer walls 142, 152 are adapted to engage the inner circumference of a drain pipe with a press fit.

In an embodiment, the pavement drain 100 is provided with four sidewalls 105 having equal dimensions. In the embodiment, the four equally sized sidewalls form a square perimeter about the drain. In an embodiment, the drain surfaces 120 are sectional. In an example embodiment four drain surfaces 120 are provided. In an embodiment, the drain surfaces are concave to form a conical path for the liquid to flow to the drainage aperture 130. In another embodiment, the drain surfaces are flat and sloped downward from the sidewall toward the drainage aperture. In an embodiment, the drain surfaces are provided as one continuous surface. In an alternate embodiment, the pavement drain is provided with one continuous sidewall to form an elliptical perimeter (not shown), wherein an elliptical perimeter includes a circular perimeter.

In an example embodiment, wherein four equally dimensioned sidewalls 105 are provided, each side wall is provided with a length 108 of approximately 6 inches and a height 106 of approximately 2.13 inches. This example embodiment provides the pavement drain 100 with total box dimensions of approximately 6 inches in length, 6 inches in width, and 2.13 inches in height, resulting in a total box volume of approximately 76 cubic inches. The dimensions of this example embodiment provide easy installation when set with pavers having a standard dimension of 6 inches in length, 3 inches in width, and 60 mm (or about 2.36 inches) in height. In an example embodiment, the lip 110 protrudes approximately a quarter inch (0.25") above where the sidewall meats the drain surface. In a further embodiment, the lip 110 is offset a quarter inch (0.25") from the exterior surface of the sidewall.

In another example embodiment, wherein four equally dimensioned sidewalls 105 are provided, each side wall is provided with a length 108 of approximately 8 inches and a height 106 of approximately 2.13 inches. This example embodiment provides the pavement drain 100 with total box dimensions of approximately 8 inches in length, 8 inches in width, and 2.13 inches in height, resulting in a total box volume of approximately 136 cubic inches. In an example embodiment, the lip 110 protrudes approximately a quarter inch (0.25") above where the sidewall meets the drain surface. In a further embodiment, the lip 110 is offset a quarter inch (0.25") from the exterior surface of the sidewall.

In an example embodiment, the pavement drain 100 with an attached plate 200 will have a total height of approximately 2.25 inches and sit about 0.11 inches below a standard paver (500 as shown in FIG. 7). The dimensions of this example embodiment allow for easy installation of the drain pipe between the pavers of the standard dimension.

In an example embodiment, the first circular protrusion 140 of the pavement drain is provided with an inner wall 141 having a diameter of 3.25 inches such that it can retain a standard 3-inch pipe (with an outer circumference of 3.25 inches) with a press fit. The second circular protrusion 150 of the pavement drain is provided with an inner wall 151 having a diameter of 4.25 inches such that it can retain a standard 4-inch pipe (with an outer circumference of 4.25) with a press fit. In an embodiment, an adhesive is used to better secure the drain pipe to the pavement drain.

With reference to FIG. 6, an example embodiment of the pavement drain 100 is shown with drain plate 200 being attached. In the embodiment, the drain plate is set onto the planar face formed by the lip 110 and secured via screws 300 placed through the through holes 215 of the drain plate and received by threaded screw holes 115 provided in the corners of the pavement drain. In an embodiment four through holes 215 are provided in the drain plate to align with the four threaded screw holes 115 provided on the pavement drain. When attached to the pavement drain, the drain plate 200 prevents rocks, leaves, gravel, and debris from entering the pavement drain and causing clogs or backup. In an embodiment, the drain plate is approximate an eight of an inch thick. In an example embodiment, the drain plate is approximately 6 inches long, 6 inches wide, and an eighth of an inch thick.

In an example embodiment, the pavement drain 100 is comprised of plastic. In another embodiment, the pavement drain 100 is comprised of ceramic, clay, metal or another suitable material. In an example embodiment, the drain plate 200 is comprised of brass. In another embodiment, the drain plate 200 is comprised of another metal, plastic, ceramic, or another suitable material.

With reference to FIG. 7, an example embodiment of the pavement drain 100 is shown with the drain plate 200 attached. The drain pipe 600 is fit onto the first or second circular protrusion on the bottom of the pavement drain. The pavement drain is set between the pavers 500 and the top of the drain plate is positioned slightly below the tops of the pavers.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A pavement drain comprising:

a) four sidewalls forming a rectangular perimeter and a first height of the pavement drain;

b) a drain aperture at the center of the drain within the perimeter, the aperture located on a first plane, the first plane being orthogonal to the four sidewalls;

c) one or more drain surfaces extending from the four sidewalls at a second height, the second height different from the first height, defined by a second plane, to the drain aperture, the second plane being parallel to the first plane;

d) a first circular protrusion extending from the one or more drain surfaces, in a direction away from the second plane, terminating at a third plane, the third plane being parallel to the first plane and the second plane, the first circular protrusion being concentric to the drain aperture, and the first circular protrusion having a diameter greater than a diameter on the drain aperture, wherein the third plane is located within the height of the pavement drain such that the first circular protrusion does not extend beyond a bottom of the pavement drain;

e) a lip formed by the four sidewalls extending from the second plane to a fourth plane, the fourth plane being parallel to the second plane, wherein four threaded apertures to receive fasteners for a drain plate are provided on the lip, the four threaded apertures extending from the fourth plane towards the second plane, and wherein one threaded aperture is provided at each corner of the rectangular perimeter;

f) wherein the lip extends one quarter of an inch from the second plane to the fourth plane, one quarter of an inch in from an exterior surface of the four sidewalls, and one-half inch in from the corners to the perimeter; and g) a second circular protrusion extending from the one or more drain surfaces to the third plane, the second circular protrusion being concentric to the drain aperture, and the second circular protrusion having a larger diameter than the diameter of the first circular protrusion.

2. The pavement drain of claim 1, wherein each sidewall has a height of 2.125 inches and a width of 6 to 8 inches, and wherein the pavement drain has a length of 6 to 8 inches, a width of 6 to 8 inches, and the height of the pavement drain is 2.125 inches.

3. The pavement drain of claim 2, wherein the first protrusion has an inner diameter of 3.25 inches.

4. The pavement drain of claim 2, wherein the second circular protrusion has an inner diameter of 4.25 inches.

5. The pavement drain of claim 1, wherein the first circular protrusion has a diameter of 3.25 inches, and wherein the second circular protrusion has an inner diameter of 4.25 inches.

6. A pavement drain comprising:

a) four sidewalls forming a square perimeter, each sidewall having a first height of 2.125 inches and a length of 6 to 8 inches;

b) a drain aperture at the center of the drain within the perimeter, the aperture located on a first plane, the first plane being orthogonal to the four sidewalls;

c) one or more drain surfaces extending from the four sidewalls at a second height, the second height different from the first height, defined by a second plane, the second plane being parallel to the first plane, and funneling into the drain aperture;

d) a first circular protrusion extending from the one or more drain surfaces, in a direction away from the second plane, to a third plane, the third plane being parallel to the first plane and the second plane, the first circular protrusion being concentric to the drain aperture, and the first circular protrusion having a diameter greater than a diameter of the drain aperture, and having an inner wall with a diameter of 3.25 inches;

e) a second circular protrusion extending from the one or more drain surfaces to the third plane, the second circular protrusion being concentric to the drain aperture, and having an inner wall with a diameter of 4.25 inches wherein the third plane is located within the height of the four sidewalls such that the first and the second circular protrusions do not extend beyond a bottom of the pavement drain; and f) a lip formed by the four sidewalls extending from the second plane to a fourth plane, the fourth plane being parallel to the second plane; four threaded apertures to receive four screws provided on the lip, the four threaded apertures extending from the fourth plane towards the second plane; and a drain plate having four through-holes to receive the four screws, wherein the lip extends one quarter of an inch from the second plate to the fourth plane, one quarter of an inch in from an exterior surface of the four sidewalls, and one half inch in from the corners of the square perimeter, and wherein one threaded aperture is provided at each corner of the square perimeter, and wherein the drain plate is retained by the four screws passing through the four through holes of the drain plate and threaded into the four threaded apertures.

7. The pavement drain of claim 6, wherein the drain plate is 6 to 8 inches in length, 6 to 8 inches in width, and eighth of an inch in thickness.

* * * * *